United States Patent [19]

Stoffer

[11] 4,232,996

[45] Nov. 11, 1980

[54] LIGHT WEIGHT FAN ASSEMBLY

[75] Inventor: Lewis J. Stoffer, Cincinnati, Ohio

[73] Assignee: The United States of America as represented by the Secretary of the Air Force, Washington, D.C.

[21] Appl. No.: 949,368

[22] Filed: Oct. 6, 1978

[51] Int. Cl.[3] ..... F04D 29/34

[52] U.S. Cl. ..... 416/191; 416/195; 416/218; 416/230 R; 416/241 A

[58] Field of Search ..... 416/189, 190, 191, 192, 416/195, 189 R, 218, 230, 241 A

[56] References Cited

U.S. PATENT DOCUMENTS

| | | | |
|---|---|---|---|
| 3,556,675 | 1/1971 | Howald et al. | 416/190 |
| 3,601,500 | 8/1971 | Palfreyman | 416/195 |
| 3,737,250 | 6/1973 | Pilpel et al. | 416/241 A |
| 3,754,839 | 8/1973 | Bodman | 416/218 |
| 3,765,796 | 10/1973 | Stargardter et al. | 416/218 |
| 3,849,023 | 11/1974 | Klompas | 415/172 A |
| 4,017,209 | 4/1977 | Bodman | 416/218 |

FOREIGN PATENT DOCUMENTS

| | | | |
|---|---|---|---|
| 611006 | 12/1960 | Canada | 416/195 |
| 2027861 | 12/1971 | Fed. Rep. of Germany | 416/218 |
| 2558689 | 7/1976 | Fed. Rep. of Germany | 416/218 |
| 835117 | 5/1960 | United Kingdom | 416/195 |

*Primary Examiner*—Everette A. Powell, Jr.
*Assistant Examiner*—A. N. Trausch, III
*Attorney, Agent, or Firm*—Joseph E. Rusz; Richard J. Killoren

[57] ABSTRACT

A fan for use as a front fan or in the lift fan system with aircraft jet engines having blades supported by a segmented hub platform and a segmented tip platform which are supported by hub support hoops and tip support hoops. The blades are secured to the hub platform segments and tip platform segments by composite pre-preg pin stock which is inserted in holes in the tip platform, the hub platform and fan blades. The pins are placed under axial compression to expand the pin diameter to provide a precise fit. Channel members are provided between the tip hoops and the blades. Some of the channels have extensions which form seals.

3 Claims, 12 Drawing Figures

LIGHT WEIGHT FAN ASSEMBLY

RIGHTS OF THE GOVERNMENT

The invention described herein may be manufactured and used by or for the Government of the United States for all governmental purposes without the payment of any royalty.

BACKGROUND OF THE INVENTION

This invention relates to a front fan or lift fan system of aircraft jet engines.

Extremely light weight high strength structures are being constructed by state of the art filament winding and compression molding fabrication processes. These are low cost structures with maximum integrity and longer life than conventional structures. In one of these processes, filaments are wound around pins throughout a die to achieve a strong structural core. Short fiber molding or mat compound is distributed discretely within the continuous fibers to accommodate section changes, such as taper, to provide the necessary bulk to completely fill the die cavity. The combined bulk is then compression molded.

BRIEF SUMMARY OF THE INVENTION

According to this invention, the fan is made up of parts made by the filament winding and compression molding fabrication process.

The fan has a plurality of hub support hoops and tip support hoops. The fan blades have tangs which extend between the hub and tip hoops and are secured to hub platform members and tip platform members with pin stock. The pins are inserted in holes in the hub and tip segments and holes in the blades and cured in place, with heat, under axial compression to expand the pin diameter to provide a precise fit. Channel members are positioned between the blades and tip hoops. Some of the channel members have portions which extend radially beyond the tip hoops to form seals. The channels, tip platforms and hub platforms are segmented so that radial growth does not have to match the precise growth of the continuous hoops.

IN THE DRAWINGS

DETAILED DESCRIPTION OF THE INVENTION

Figure 1:
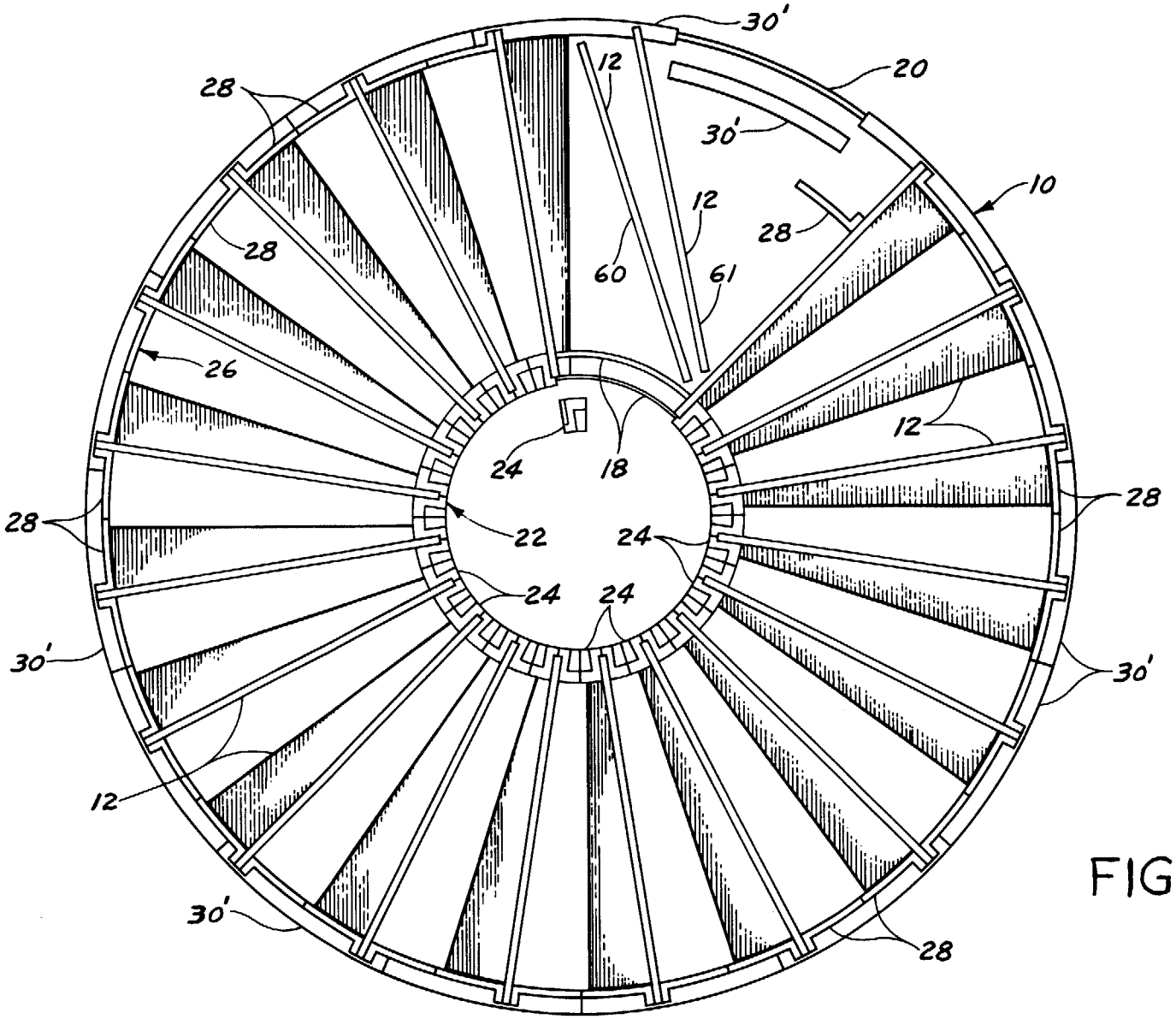
FIG. 1 is a schematic diagram of a fan, according to the invention, in the process of assembly.
Figure 8:
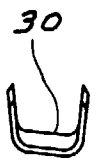
FIG. 8 is a right end view of the device of FIG. 7.
Figure 7:
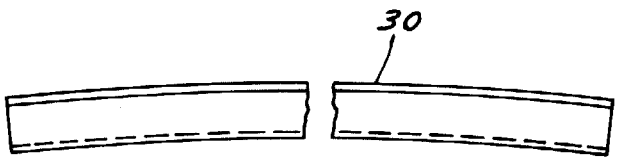
FIG. 7 shows a channel member used in the device of FIG. 1.
Figure 2:
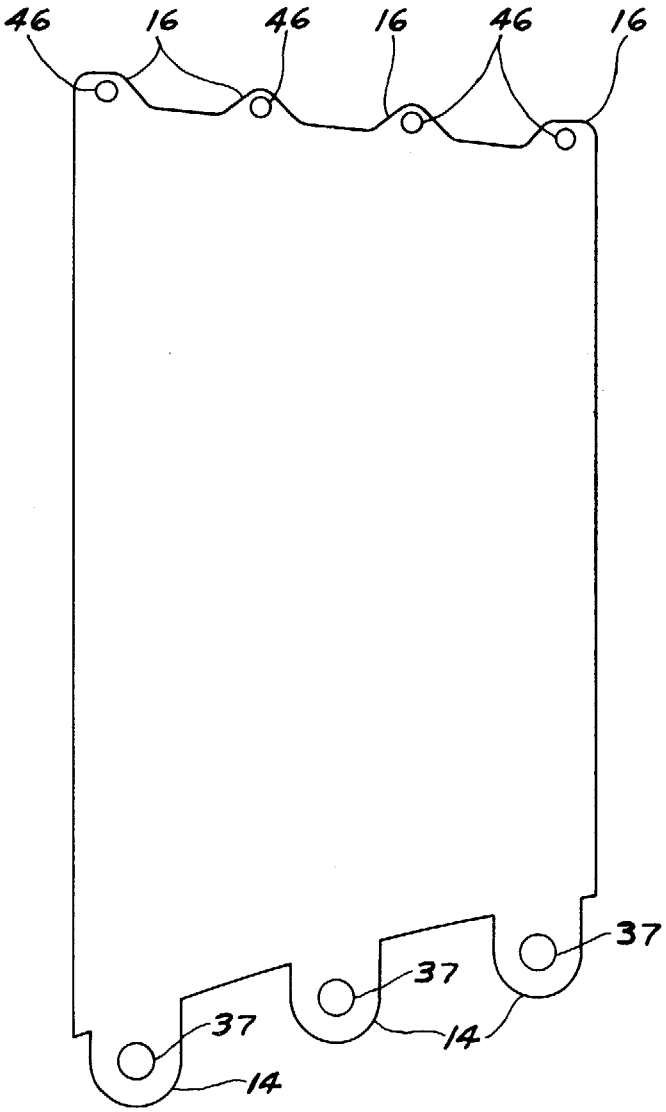
FIG. 2 shows a fan blade member which may be used in the device of FIG. 1.
Figure 6:
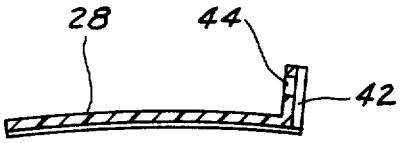
FIG. 6 is a sectional view of the device of FIG. 5 along the line 6—6.
Figure 5:
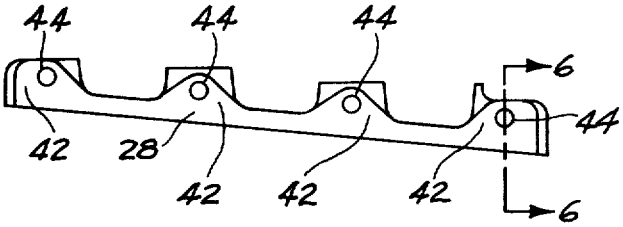
FIG. 5 shows a tip platform segment which may be used in the device of FIG. 1.
Figure 4:
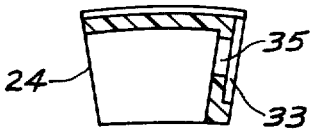
FIG. 4 is a sectional view of the device of FIG. 3, along the line 4—4.
Figure 3:
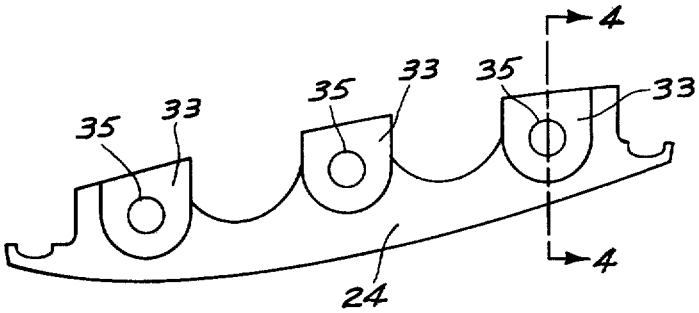
FIG. 3 shows a hub platform segment which may be used in the device of FIG. 1.
Figure 9:
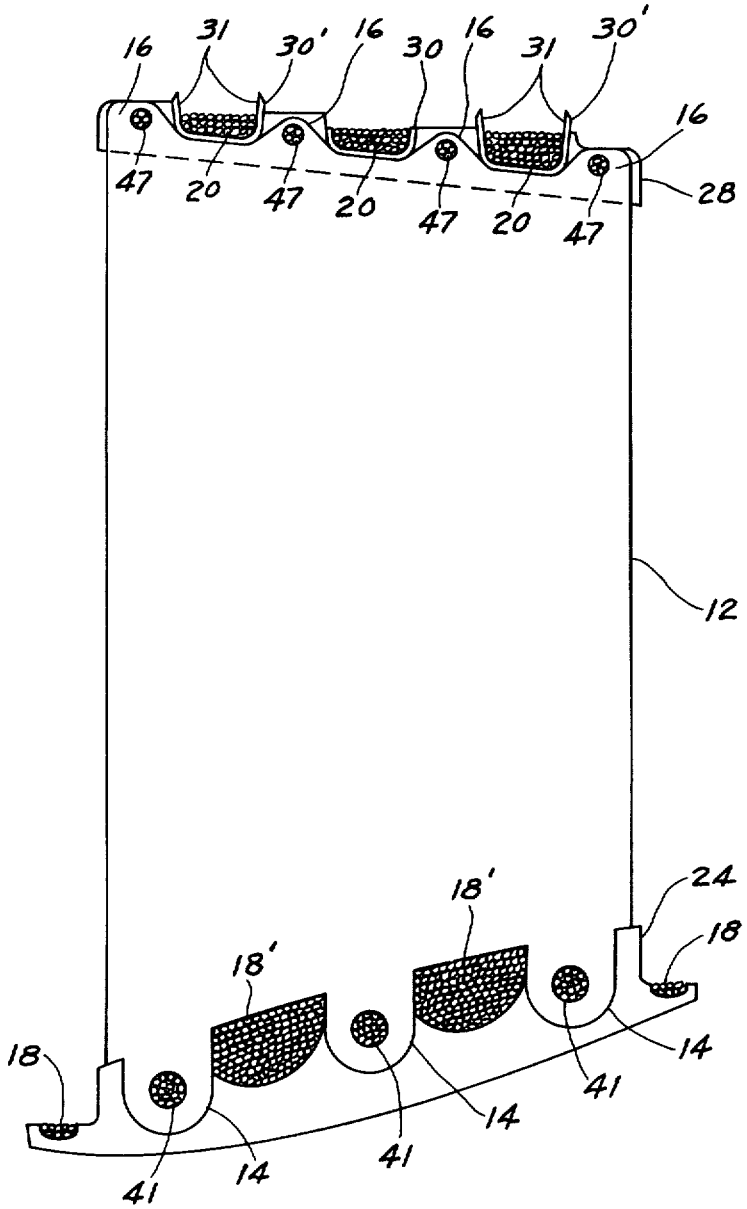
FIG. 9 is a side view of an assembled blade member showing the relative positioning of the blade hoops; hub and tip platform segments and channel members.

Reference is now made to FIG. 1 of the drawing which shows a partially assembled fan 10 having a plurality of blade members 12 which could have a configuration as shown in FIG. 2. Each blade has inner and outer tangs 14 and 16 which fit around the inner and outer hoop members 18' and 20 as shown in FIG. 9. The hub platform 22 includes a plurality of platform segments 24, which have a configuration as shown in FIGS. 3 and 4. A tip platform 26 includes a plurality of platform segments 28, which have a configuration as shown in FIGS. 5 and 6. Sheet metal channel members 30 fit between the blade members 12 and the hoop members 20 as shown in FIG. 9. The channel members 30' have radial extensions 31 which form seals. The hoops, blades, hub platform segments and tip platform segments are fiber reinforced composite structures made by conventional filament winding and compression molding fabrication processes.

Figure 10:
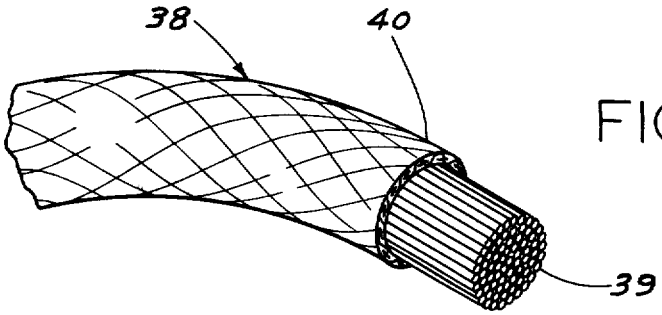
FIG. 10 shows a length of conventional pre-preg pin stock used in the device of FIG. 1.

The hub platform segments 24 have recesses 33 for receiving tangs 14 of the blades 12. Holes 35 match holes 37 in tangs 14. A piece of continuous pre-preg pin stock 38, as shown in FIG. 10, which includes fibers 39 in a binder within a woven sock 40, is cut to the desired length and inserted in holes 35 and 37, as shown at 41. The pin 41 is then compressed with, electrically or RF heated, tongs 43 as shown in FIG. 11, to expand the pins and extend their diameter to provide a precise fit in the holes.

The tip platform segments 28 have recesses 42 for receiving tangs 16 of blades 12. Holes 44 match holes 46 in tangs 16. Pieces of pre-preg pin stock, of smaller diameter than that used in holes 35 and 37, are cut to the desired length and inserted in holes 44 and 46. The pins 47, after curing in the manner described above, are as shown in FIG. 12. The fibers in blade 12, hub platform segments 24 and tip platform segments 28 are wound around pins in the mold which are positioned to correspond to holes 35, 37, 44 and 46 to provide strong structural support. The fibers as illustrated at 48, 49, 50 and 51 in FIGS. 11 and 12 surround pins 41 and 47 to provide strong support for the blades 12. The hub and tip hoops are made with glass fibers, in a binder. Glass fiber hoops in these configurations have demonstrated working stresses in excess of 250,000 psi. The hoops are sized so that centrifugal growth of the system maintains equilibrium in the blade attachments at both the hub and the tip. The size of the tip hoops is selected to induce a small compression in the blade tip so that some division of blade load is carried between the hub and tip hoops. The division of load should be balanced at a point in the radial span of the blade where sufficient camber is present to inhibit flexing of the blade.

In the assembly of the fan the hoops 18, 18' and 20 are jigged concentric in the spacial relationship substantially as shown in FIG. 9. The blades are placed between the inner and outer hoops and rotated into position with tangs 14 and 16 extending between the hoops. Before the blades are inserted between the hoops, sections of channel members 30 are fit around the tip hoops 20.

Figure 12:
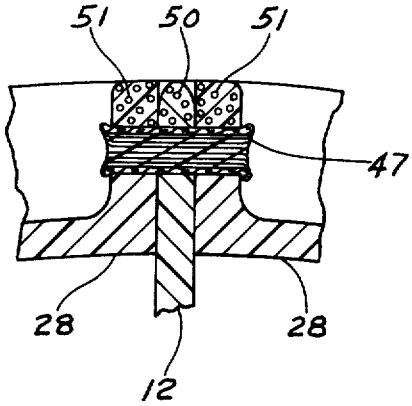
FIG. 12 shows the securing pins for the blade and tip platform members.
Figure 11:
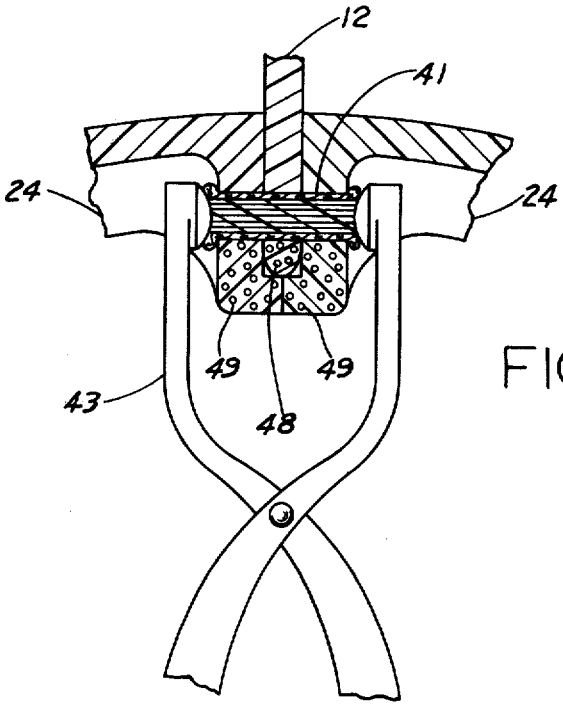
FIG. 11 shows the in-place curing of the securing pins for the blade and hub platform members.

As each blade 12 is positioned between the hoops, hub platform segments 24 are positioned on opposite sides of the blade and secured to the blade with pin stock as shown in FIG. 11. The hoops 18' are clamped between the blades 12 and hoop segments 24, as shown in FIG. 9. The tip platform segments are then positioned on opposite sides of the blade and secured with pin stock, as shown in FIG. 12.

Due to space limitations, the last two blades 12 should be inserted at the same time as shown at 60 and 61 in FIG. 1. With channel segments 30 moved into position around hoops 20, the last two blades are rotated into place at the same time. Hub platform segments and tip platform segments are then secured to the blades as described above. Though the outer portion of hub segments has a greater circumferential span than the inner portion, there is sufficient give in hoops 18 and 18' to permit insertion of the last hub platform segment. After the complete assembly of the fan, the hub platform cavities could be filled with rubber or foam materials to assist in securing the pins 41 and to damp vibrations. The fan can then be mounted on a drive shaft for use.

If there is a need to replace any of the blades, the pins 41 and 47 can be drilled out to permit disassembly.

There is thus provided a high strength light weight fan for use in a front fan or lift fan system with aircraft jet engines.

I claim:

1. A fan assembly, comprising: a plurality of fiber reinforced composite hub support hoops; a plurality of fiber supported composite tip support hoops radially spaced from said hub support hoops; a plurality of fiber reinforced composite fan blades positioned between the hub support hoops and the tip support hoops; a segmented fiber reinforced composite hub platform secured to said blades with the hub support hoops held between the blades and the hub platform segments and a segmented, fiber reinforced composite tip platform secured to said blades; a plurality of metal channel segments positioned adjacent the tip hoops between the tip hoops and the blades; the hub platform segments and tip platform segments being secured to the blades with heat-and-compression-cured locking pins; said blades, said hub platform segments and said tip platform segments having reinforcing fibers passing around the locking pins.

2. The device as recited in claim 1 wherein said tip hoops are sized to induce a small compression in the blade tips.

3. The method of constructing a fan for use with a jet engine, comprising: forming a plurality of fiber reinforced composite hub support hoops, a plurality of fiber reinforced tip support hoops, a plurality of fiber reinforced composite fan blade members having inner and outer tangs, a plurality of fiber reinforced composite hub platform segments and a plurality of fiber reinforced composite tip platform segments by a conventional filament winding and compression molding process; placing each blade between the hub support hoops and the tip support hoops and with the tangs extending between the hoops; positioning hub platform segments on opposite sides of the blades with hub support hoops being positioned between the blades and the hub platform segments; securing the blades to an adjacent hub platform segments by placing pre-preg pin stock in holes in corresponding blade tangs and hub segments; securing the pin stock to the hub platform segments and blades by heating and compressing the pin stock; fitting metal channel members between the blade members and the tip support hoops; positioning tip platform segments on opposite sides of the blades; securing the blades to adjacent tip platform segments by placing pre-preg pin stock in holes in corresponding blade tangs and tip segments; securing the pin stock to the tip platform segments and blades by heating and compressing the pin stock.

* * * * *